United States Patent [19]

Horiuchi et al.

[11] Patent Number: 4,474,152

[45] Date of Patent: Oct. 2, 1984

[54] IDLE ADJUSTING DEVICE FOR AN INTERNAL COMBUSTION ENGINE

[75] Inventors: Tomofusa Horiuchi, Yokohama; Yoshiaki Nishi, Tokyo, both of Japan

[73] Assignees: Nissan Motor Company, Ltd., Yokohama; Nippon Carburetor Company, Ltd., Tokyo, both of Japan

[21] Appl. No.: 376,010

[22] Filed: May 7, 1982

[30] Foreign Application Priority Data

May 11, 1981 [JP] Japan ..... 56-67705

[51] Int. Cl.[3] ..... F02M 3/00

[52] U.S. Cl. ..... 123/339; 123/585

[58] Field of Search ..... 123/339, 585, 587

[56] References Cited

U.S. PATENT DOCUMENTS 4,201,169 5/1980 Michassouridis ..... 123/339
4,300,501 11/1981 Suzuki ..... 123/339
4,385,603 5/1983 Bonse et al. ..... 123/339
4,401,074 8/1983 Horiuchi et al. ..... 123/339
4,412,517 11/1983 Kobashi et al. ..... 123/339

FOREIGN PATENT DOCUMENTS 55-161037 11/1980 Japan .

*Primary Examiner*—Parshotam S. Lall
*Assistant Examiner*—W. R. Wolfe
*Attorney, Agent, or Firm*—Schwartz, Jeffery, Schwaab, Mack, Blumenthal & Koch

[57] ABSTRACT

An idle adjusting device for an engine having an air intake passage and a throttle valve disposed in the air intake passage, includes an auxiliary passage communicating with the air intake passage in such a manner as to bypass the throttle valve. A first member protrudes into the auxiliary passage so as to locally reduce the cross-sectional area of the auxiliary passage. A second member movably protrudes into the auxiliary passage at a position relatively near the first member so that the first and second members will cooperate to adjust the effective cross-sectional area of the auxiliary passage in accordance with movement of the second member.

9 Claims, 5 Drawing Figures

IDLE ADJUSTING DEVICE FOR AN INTERNAL COMBUSTION ENGINE

BACKGROUND OF THE INVENTION

1. Field of the Invention

This invention relates to a device for adjusting the flow rate of air or air-fuel-mixture drawn into an internal combustion engine during idling.

2. Description of the Prior Art

Internal combustion engines usually have an auxiliary air passage which bypass the engine throttle valve. The auxiliary passage permits air to be drawn into the engine when the throttle valve is closed. A screw is located in the auxiliary passage to adjust the effective cross-sectional area thereof to determine the flow rate of air drawn into the engine during idling.

The engines usually have positive crankcase ventilation (PCV) and exhaust gas recirculation (EGR) systems for emission control. These systems inevitably discharge contaminants, such as oil or carbon particles, into the fresh air drawn into the engine. In addition, some dirt passes through the intake air filter or cleaner and is entrained with engine intake air.

When contaminants or dirt accumulate on the idle adjusting screw, the effective cross-sectional area of the auxiliary passage decreases from its nominal value, reducing the flow rate of air into the engine during idling. This causes a reduction in the engine rotational speed during idling. Conventional idle adjusting screws have been unsatisfactory from the standpoint of their ability to prevent contaminants or dirt from adhering thereto and accumulating thereon.

SUMMARY OF THE INVENTION

Accordingly, it is an object of the present invention to provide an idle air or air-fuel-mixture flowrate adjusting device for an internal combustion engine which adequately prevents contaminants or dirt from adhering thereto and accumulating thereon.

According to the present invention, an idle adjusting device for an engine having an air intake passage and a throttle valve disposed in the air intake passage is provided. The idle adjusting device comprises an auxiliary passage communicating with the air intake passage in such a manner as to bypass the throttle valve. A first member protrudes into the auxiliary passage so as to locally reduce the cross-sectional area of the auxiliary passage. A second member movably protrudes into the auxiliary passage at a position relatively near the first member so that the first and second members will cooperate to adjust the effective cross-sectional area of the auxiliary passage in accordance with movement of the second member.

The above and other objects, features and advantages of the present invention will be apparent from the following description of preferred embodiments thereof, taken in conjunction with the drawings.

DETAILED DESCRIPTION OF THE PREFERRED EMBODIMENTS

Figure 1:
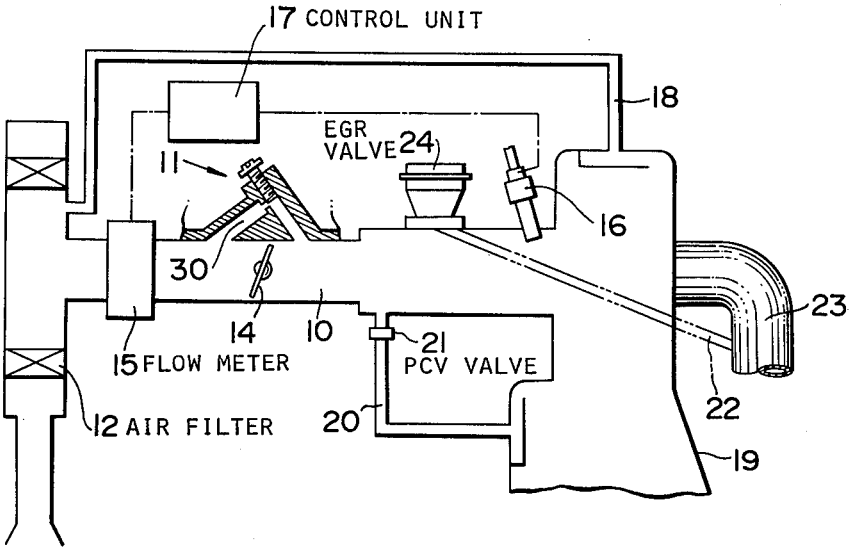
FIG. 1 is a diagrammatic view of an internal combustion engine air-intake system including an idle adjusting device according to a first embodiment of the present invention.

With reference to FIG. 1, there is shown an internal combustion engine air-intake system which includes an air intake passage 10 and an idle adjusting device 11 according to a first embodiment of the present invention. The air passage 10 is connected at one end to an air cleaner or filter 12 and at the other end to combustion chambers (not shown) to supply fresh air from the cleaner 12 to the combustion chambers. However, unfiltered dirt passes the cleaner 12 and is entrained with air. A throttle valve 14 is disposed in the air passage 10.

An air flow meter 15 is located in the air passage 10 upstream of the throttle valve 14 to measure the flow rate of air drawn into the combustion chambers. One or more fuel injection valves 16 open to the air passage 10 downstream of the throttle valve 14. A computer-equipped control unit 17 receives the air-flow-rate signal from the meter 15 and controls the fuel injection valves 16 in response to the air-flow-rate signal so as to supply the combustion chambers with a mixture of the desired air-fuel ratio.

A positive crankcase ventilation (PCV) intake passage 18 is connected at one end to the air passage 10 downstream of the air cleaner 12 but upstream of the air flow meter 15, and at the other end to an crankcase 19 so as to supply fresh-air into the latter. A PCV discharge passage 20 is connected at one end to the crankcase 19 and at the other end to the air passage 10 downstream of the throttle valve 14 so as to discharge air containing blow-by gas into air to be drawn into the combustion chambers. A PCV valve 21 is disposed in the discharge passage 20 to control the air-flow past the passages 18 and 20. This PCV system inevitably discharge contaminants, such as oil, into air drawn into the combustion chambers.

An exhaust gas recirculation (EGR) passage 22 is connected at one end to an exhaust passage 23 and at the other end to the intake passage 10 downstream of the throttle valve 14, so as to recirculate exhaust gas through the combustion chambers. An EGR valve 24 is disposed in the passage 22 to control the flow rate of exhaust gas recirculated. This EGR system inevitably discharges contaminants, such as carbon particles, into air entering the combustion chambers.

One end of an auxiliary air passage 30 is connected to the main air passage 10 upstream of the throttle valve 14 but downstream of the air flow meter 15. The other end of the auxiliary passage 30 is also connected to the main passage 10 downstream of the throttle valve 14 upstream of the fuel injection valves 16, the junction with the PCV discharge passage 20, and the junction with the EGR passage 22. Thus, the auxiliary passage 30 bypasses the throttle valve 14 so as to allow some air flow toward the combustion chambers when the throttle valve 14 is closed to idle the engine. The device 11 is disposed in the auxiliary passage 30 to adjust the effective cross-section area thereof so as to determine the flow rate of air into the combustion chambers during idling.

All the above-mentioned structures of the internal combustion engine are essentially identical with those of a conventional engine, except the detailed arrangement of the idle air adjusting device 11, which will be explained immediately hereafter.

Figure 2:
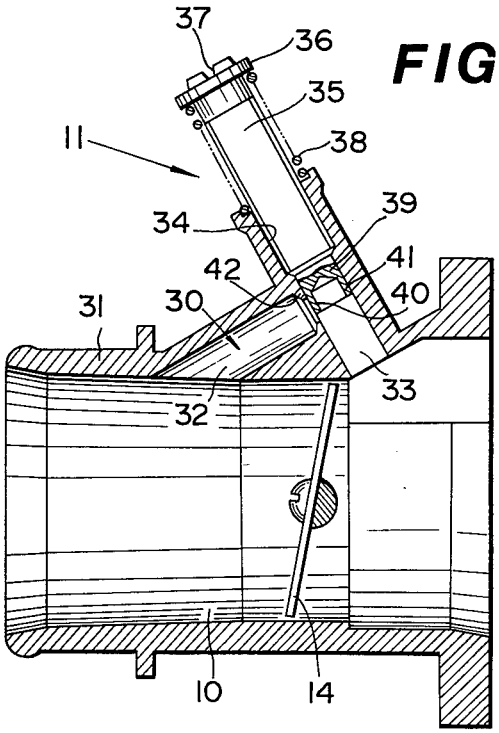
FIG. 2 shows a longitudinal section of the air intake passage including the idle adjusting device of FIG. 1.
Figure 3:
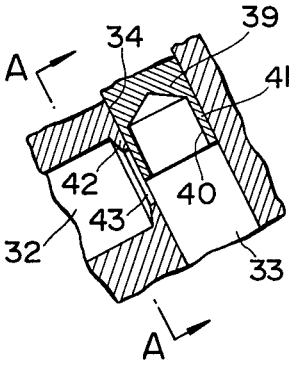
FIG. 3 is an enlarged view of the idle adjusting device in FIG. 1.
Figure 4:
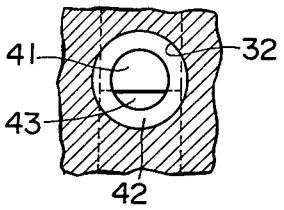
FIG. 4 is a sectional view taken along line A—A of FIG. 3.

As shown in FIGS. 2 to 4, the auxiliary air passage 30 is provided in the wall of a duct 31 having therein the throttle valve 14 and forming a part of the main air passage 10. The auxiliary 30 includes inlet and outlet ports 32 and 33 of circular cross-section which open to the main passage 10 at points upstream and downstream of the throttle valve 14, respectively. The inlet and outlet ports 32 and 33 are mutually perpendicular and intersect near their distal ends to directly connect with each other. The outlet port 33 has a constant inside diameter.

A bore 34 is formed through the wall of the duct 31. The part of the bore 34 near the main passage 10 constitutes the outlet port 33, while the distal end thereof is threaded. A screw 35 of the idle adjusting device 11 is partially inserted into the bore 34 and engages the wall of the duct 31 via the threads, moving axially along the bore 34 in accordance with rotation thereof. The head 36 of the screw 35 projects out of the distal end of the bore 34. The head 36 has a groove 37 which enables the screw 35 to engage a suitable tool, such as a screwdriver, so that the screw 35 can be easily rotated. A compressed helical spring 38 is seated between the screw head 36 and the duct wall 31 to urge the screw 35 away from the bore 34. As long as substantially no torque is exerted on the screw 35, the spring 38 holds the screw 35 in place relative to the duct wall 31.

As shown in FIGS. 2 and 3, the tip 39 of the screw 35 is normally in the outlet port 33 and is provided with an axially-extending circular recess 40 to form a concentric annular projection 41. This tip 39 of the screw 35 has such a smooth peripheral surface and an outside diameter dimensioned to snugly but slidably fit in the outlet port 33. Thus, the tip 39 of the screw 35 is permitted to essentially contact the duct wall 31 throughout its periphery to seal the distal end of the outlet port 33.

As shown in FIGS. 2 to 4, at the opening of the inlet port 32 to the outlet port 33, the duct wall 31 is formed with a radially-extending annular projection 42 concentric with the inlet port 32 to locally reduce the cross-sectional area of the inlet port 32. Thus, the inlet port 32 opens to the outlet port 33 by way of the central aperture 43 through the annular projection 42. The downstream end face of the annular projection 42 is flush with the surface of the outlet port 33 and thus conforms to the periphery of the screw tip 39, so as to be able to substantially contact with the peripheral surface of the screw tip 39. Therefore, the tip 39 of the screw 35 can slide over the end face of the annular projection 42 and gradually block the central aperture 43 in accordance with the axial movement thereof.

As the tip 39 of the screw 35 advances axially along the outlet port 33 while rotating, the tip 39 varies the cross-sectional area of the opening of inlet port 32 to outlet port 33 by way of the central aperture 43. In this way, the projection 42 and the tip 39 of the screw 35 cooperate to constitute a valve which can adjust the effective cross-sectional area of the auxiliary passage 30 in accordance with rotation of the screw 35. Specifically, the relative position of the projections 41 and 42 determines the effective cross-sectional area of the auxiliary passage 30. During engine idling, the throttle valve 14 is closed and air enters the combustion chambers via the main air passage 10, the inlet port 32, the central aperture 43, and the outlet port 33, being metered by the valve composed of the projection 42 and the screw tip 39. Since rotation of the screw 35 causes axial movement thereof, the angular position of the screw 35 determines the flow rate of air drawn into the combustion chambers during engine idling.

The portions of the annular projections 41 and 42 which actually determine the effective cross-sectional area of the auxiliary passage 30 have reduced total surface areas, thereby decreasing the probability of deposition of airborne contaminants or dirt onto the projections 41 and 42 which would adversely influence the effective cross-sectional area of the auxiliary passage 30. The projections 41 and 42 are preferably thin to further reduce the total surface areas which actually determine the effective cross-sectional area of the auxiliary passage 30. The tips of the projections 41 and 42 may be in the form of a knife-edge for the same reason. The projections 41 and 43 act to increase the air speed and produce turbulence in the air flow, thereby effectively preventing airborne contaminants or dirt from adhering to and accumulating on the tips thereof which actually determine the effective cross-sectional area of the auxiliary passage 30. The perpendicular junction of the inlet and outlet ports 32 and 33 also causes turbulence in the air flow.

Figure 5:
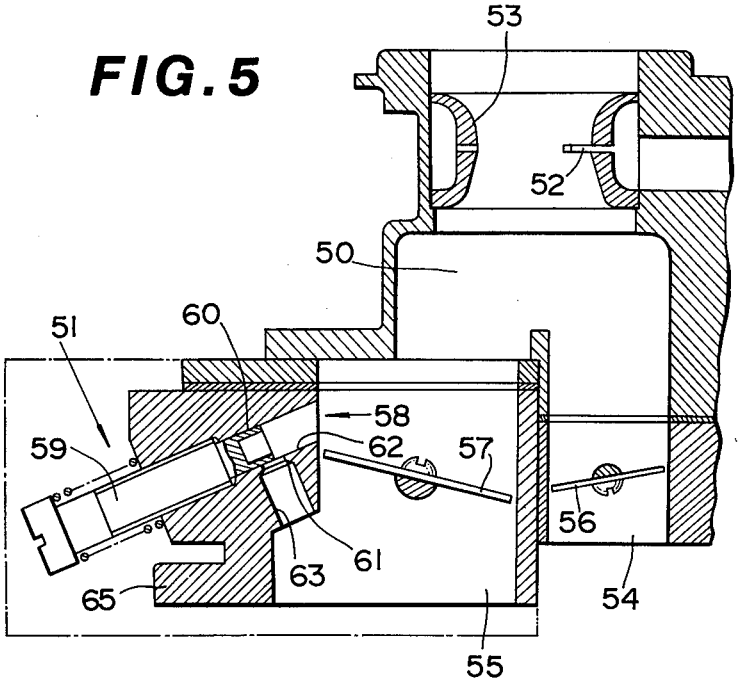
FIG. 5 shows a longitudinal section of an engine intake passage including an idle adjusting device according to a second embodiment of the present invention.

FIG. 5 shows an air intake system of an internal combustion engine using liquefied petroleum gas (LPG) as fuel. The air intake system includes an air intake passage 50 and an idle adjusting device 51 according to a second embodiment of the present invention. A gas injection nozzle 52 opens into the air passage 50 at a venturi 53 formed in the air passage 50. At a position downstream of the venturi 53, the air passage 50 is divided into primary and secondary parallel branches 54 and 55, in which primary and secondary throttle valves 56 and 57 are disposed respectively.

The wall 65 of a duct forming the secondary passage 55 is provided with an auxiliary air passage 58 communicating with the secondary passage 55 in such a manner as to bypass the secondary throttle valve 57. The idle adjusting device 51 has a screw 59, an annular projection 60 at the tip of the screw 59, and an annular projection 61 extending from the duct wall 65 to locally reduce the cross-sectional area of the auxiliary passage 58. The auxiliary passage 58 and the idle adjusting device 51 are designed in a manner similar to those of the previous first embodiment except for the following points.

The auxiliary passage 58 includes perpendicular inlet and outlet ports 62 and 63 opening to the secondary passage 55 upstream and downstream of the secondary throttle valve 57 respectively. The inlet and outlet ports 62 and 63 connect with each other near their distal ends. The tip of the screw 59 is located in the inlet port 62. The annular projection 61 is located in the outlet port 63 adjacent to the opening of the outlet port 63 to the inlet port 62. The adjusting device 51 adjusts the effective cross-sectional area of the auxiliary passage 58 in a way similar to that of the previous first embodiment. In this case, the projections 60 and 61 act to prevent contaminants, such as tar contained in LPG, from adhering to and accumulating on the tips of the projections 60 and 61 in a way similar to that of the previous first embodiment.

It should be understood that further modifications and variations may be made in the present invention without departing from the spirit and scope of the present invention as set forth in the appended claims. For example, the idle adjusting device 11 or 51 may be located along a straight auxiliary passage, provided that the other features described hereinabove produce sufficient turbulence and air speed to effectively prevent airborne contaminant deposition.

What is claimed is:

1. An idle adjusting device for an engine having an air intake passage, a throttle valve disposed in the air intake passage, and an auxiliary passage communicating with the air intake passage for bypassing the throttle valve, the adjusting device comprising:

(a) a first member disposed in the auxiliary passage to locally reduce the cross-sectional area of the auxiliary passage; and (b) a second member movably projecting into the auxiliary passage at a position generally adjacent the first member, the first and second members cooperating to adjust an effective cross-sectional area of the auxiliary passage in accordance with a position of the second member relative to the first member, the second member having a tip portion formed with a blind bore to produce air flow turbulence in said auxiliary passage.

2. An idle adjusting device as recited in claim 1, wherein the first member comprises an annular passage having a central aperture, said first member being coaxial with at least a portion of the auxiliary passage.

3. An idle adjusting device as recited in claim 2, wherein the second member is movable along an axis thereof and said tip portion projects in the direction of said axis and has a symmetrical cross-section with respect to said axis.

4. An idle adjusting device as recited in claim 3, wherein an end face of the first member adjacent the second member conforms to a peripheral surface of the tip portion, the second member being operable when moved to slide along the end face of the first member and partially block the central aperture in accordance with the position of the second member.

5. The idle adjusting device of claim 4, wherein the peripheral surface of said tip portion is dimensioned to snugly fit within said auxiliary passage to thereby seal air from flowing past said tip portion.

6. The idle adjusting device of claim 3, wherein said first member has an end face which conforms with a peripheral surface of said tip portion to form therewith an air flow adjustment valve operable to vary an open area of said central aperture and thereby the effective cross-sectional area of the auxiliary passage as said second member moves along said axis.

7. The idle adjusting device of claim 6, wherein said blind bore has a peripheral projection and said first member has an annular projection which cooperate to determine said open area of said central aperture, said peripheral projection and annular projection being formed as knife-edge projections to increase air flow speed therepast and turbulence thereby reducing deposition of airborne contaminants thereon.

8. An idle adjusting device as recited in any one of claims 1 to 4 or 5, wherein the auxiliary passage includes generally mutually orthogonal inlet and outlet ports opening to the air intake passage upstream and downstream of the throttle valve respectively, the inlet port communicating with the outlet port at a junction, the first member being disposed in the outlet port adjacent said junction.

9. An idle adjusting device as recited in any one of claims 1 to 4 or 5, wherein the auxiliary passage includes generally mutually orthogonal inlet and outlet ports opening to the air intake passage upstream and downstream of the throttle valve respectively, the outlet port communicating with the inlet port at a junction, the first member being disposed in the outlet port adjacent said junction, the second member being disposed in the inlet port adjacent said junction.

* * * * *